US008379899B2

(12) United States Patent
Van Halteren

(10) Patent No.: US 8,379,899 B2
(45) Date of Patent: Feb. 19, 2013

(54) ELECTRO-ACOUSTICAL TRANSDUCER AND A TRANSDUCER ASSEMBLY

(75) Inventor: Aart Zeger Van Halteren, Hobrede (NL)

(73) Assignee: Sonion Nederland B.V., Amsterdam (NL)

( * ) Notice: Subject to any disclaimer, the term of this patent is extended or adjusted under 35 U.S.C. 154(b) by 1460 days.

(21) Appl. No.: 11/263,670

(22) Filed: Oct. 31, 2005

(65) Prior Publication Data

US 2006/0109999 A1 May 25, 2006

Related U.S. Application Data

(60) Provisional application No. 60/623,278, filed on Nov. 1, 2004, provisional application No. 60/696,595, filed on Jul. 5, 2005.

(51) Int. Cl.
*H04R 25/00* (2006.01)

(52) U.S. Cl. ..... 381/352; 381/351; 381/386; 381/396

(58) Field of Classification Search ..... 381/322, 381/325, 345–354, 386, 396, 324
See application file for complete search history.

(56) References Cited

U.S. PATENT DOCUMENTS

| | | | | |
|---|---|---|---|---|
| 388,069 | A * | 8/1888 | Thuras | 83/817 |
| 2,958,739 | A * | 11/1960 | Schoeps et al. | 381/356 |
| 4,450,930 | A | 5/1984 | Killion | 181/158 |
| 4,815,560 | A * | 3/1989 | Madaffari | 181/158 |
| 4,837,833 | A * | 6/1989 | Madaffari | 381/322 |
| 6,549,634 | B1 * | 4/2003 | Vonlanthen | 381/322 |
| 6,813,364 | B1 * | 11/2004 | Vonlanthen | 381/322 |
| 7,076,074 | B2 * | 7/2006 | Gebert et al. | 381/322 |
| 7,088,839 | B2 * | 8/2006 | Geschiere et al. | 381/368 |
| 7,106,878 | B2 * | 9/2006 | Saiki et al. | 381/396 |
| 7,110,565 | B1 * | 9/2006 | Engbert et al. | 381/418 |
| 7,305,098 | B2 * | 12/2007 | Vonlanthen et al. | 381/312 |
| 7,366,317 | B2 * | 4/2008 | Miller et al. | 381/396 |
| 7,492,919 | B2 * | 2/2009 | Engbert et al. | 381/418 |
| 2002/0136425 | A1 * | 9/2002 | Warren | 381/423 |
| 2005/0002542 | A1 * | 1/2005 | Warren et al. | 381/424 |

FOREIGN PATENT DOCUMENTS

| | | |
|---|---|---|
| DE | 3540106 | 5/1987 |
| EP | 1257147 | 11/2002 |
| EP | 1 341 395 A1 | 9/2003 |
| EP | 1 562 400 A2 | 8/2005 |
| GB | 388069 | 5/1931 |
| WO | WO 2005/000158 | 1/2005 |

OTHER PUBLICATIONS

European Search Report for European Patent Application No. 05023742.9, dated Oct. 20, 2008.

* cited by examiner

*Primary Examiner* — Curtis Kuntz
*Assistant Examiner* — Jasmine Pritchard
(74) *Attorney, Agent, or Firm* — Nixon Peabody LLP

(57) ABSTRACT

An electro-acoustical transducer comprising DC atmospheric pressure equalization vents for equalizing pressure in both chambers therein. The sound port of the transducer may be sealed by a sound conducting member preventing gas flow there through. The transducer may have a single vent extending in a plane of a side portion, which vent may have a meandering path or may comprise tapering portions or cavities defining acoustical properties thereof.

10 Claims, 11 Drawing Sheets

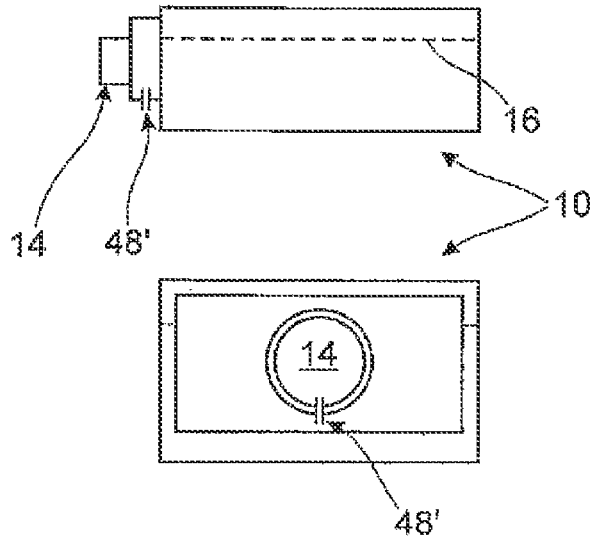
Figure 13
Figure 14a
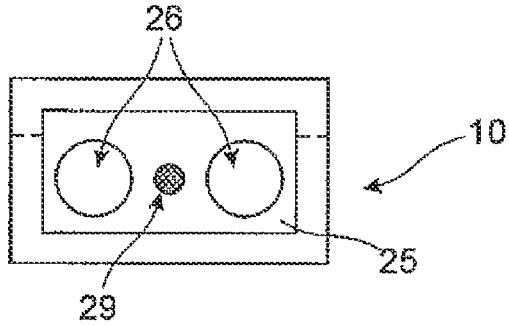
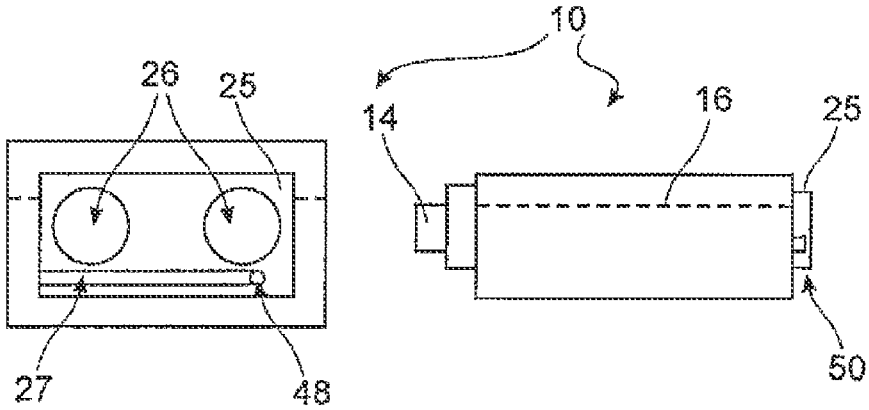
Figure 14b

ELECTRO-ACOUSTICAL TRANSDUCER AND A TRANSDUCER ASSEMBLY

CROSS REFERENCE TO RELATED APPLICATIONS

This application claims priority to U.S. provisional application Ser. No. 60/623,278, filed on Nov. 1, 2004, and to U.S. Provisional application Ser. No. 60/696,595, filed on Jul. 5, 2005. The disclosures of the aforementioned provisional applications are incorporated by reference in their entirety herein.

FIELD OF THE PRESENT INVENTION

The present invention relates to an electro-acoustical transducer, and a transducer assembly comprising the transducer, which transducer is adapted to operate with a sealed sound port blocked by an air impervious member or fabric. The electro-acoustical transducer and the transducer assembly according to the invention contain first and second gas flow channels to provide necessary static pressure compensation to internal chambers of a transducer housing.

BACKGROUND OF THE PRESENT INVENTION

In prior art electro-acoustical transducers, two separate chambers, often termed front and back volumes, exist into one of which sound from the surroundings is conveyed—or from which sound generated therein is transmitted to the surroundings. Static pressure compensation has traditionally been provided to the other chamber by a small vent or aperture between the front volume and the back volume. This vent provides a gas flow channel between interiors of the front and back volume so as to maintain a static pressure difference of substantially zero between two sides of a deflectable diaphragm. This vent or gas flow channel may have dimensions sufficiently small to prevent pressure changes with frequencies much higher than a DC level to pass between the front and back volumes. Consequently, the vent may only serve the purpose of pressure equalization in the inner space, or back volume, not connected directly with the surroundings via the sound port. A transducer of this type is disclosed in U.S. Pat. No. 4,450,930.

In applications where the sound port of the transducer is blocked by the air impervious member it has been found advantageous to provide pressure equalization of both inner spaces independently of the sound port.

SUMMARY OF THE PRESENT INVENTION

Thus, in a first aspect, the invention relates to an electro-acoustical transducer comprising a transducer housing, having an inner space. The electro-acoustical transducer comprises a sound port, a deflectable diaphragm, and a first and second gas flow channel. The sound port is adapted to convey sound between the inner space and the surroundings. The deflectable diaphragm is responsive to received sound or adapted to generate sound. The diaphragm divides the inner space into a first and a second, separate chambers. The first and the second gas flow channels are adapted to facilitate gas transport there through between the surroundings and the first and the second chambers.

A second aspect of the invention relates to a transducer assembly comprising an electro acoustical transducer as described above and a sound transporting member adapted to transport sound between the surroundings and the sound port.

The sound is blocked with an element that is adapted to transport sound and is substantially impervious to gas flow.

A third aspect of the invention relates to an electro-acoustical transducer comprising a transducer housing, having one or more side portions and an inner space. The transducer comprises a deflectable diaphragm, a sound port, and a channel. The deflectable diaphragm is responsive to received sound or adapted to generate sound. The diaphragm divides the inner space of the housing into a first and a second, separate chambers. The sound port is adapted to transport sound between the first chamber and the surroundings. The channel extends between a first opening toward one of the first and second chambers and a second opening to the surroundings. The channel is adapted to facilitate gas transport there through between the first or second chamber and the surroundings. The channel has dimensions providing a transfer function between a sound pressure in the first or second chamber and a sound pressure at the second opening of the channel. The transfer function has a cut-off frequency, measured under free field conditions, of less than 100 Hz, such as less than 50 Hz, or such as less than 20 Hz. At least part of the channel extends within a side portion and substantially along a plane thereof.

A fourth aspect of the invention relates to a miniature hearing aid receiver, microphone, or loudspeaker comprising an electro-acoustical transducer or an assembly as described above.

A fifth aspect of the invention relates to an electro-acoustical transducer comprising a transducer housing having an inner space. The electro-acoustical transducer comprises a sound port, a deflectable diaphragm, and a gas flow channel. The sound port is adapted to convey sound between the inner space and the surroundings. The deflectable diaphragm is responsive to received sound or adapted to generate sound. The gas flow channel is adapted to facilitate gas transport there through between the surroundings and the inner space. The gas flow channel comprises an opening through the transducer housing and a porous member covering the opening.

The above summary of the present invention is not intended to represent each embodiment, or every aspect, of the present invention. Additional features and benefits of the present invention are apparent from the detailed description, figures, and claims set forth below.

BRIEF DESCRIPTION OF THE DRAWINGS

In the following, preferred embodiments will be described with reference to the drawing, wherein:

FIG. 13 illustrates a eighth embodiment according to the invention;

FIG. 14 illustrates a ninth embodiment according to the invention;

Figure 1:
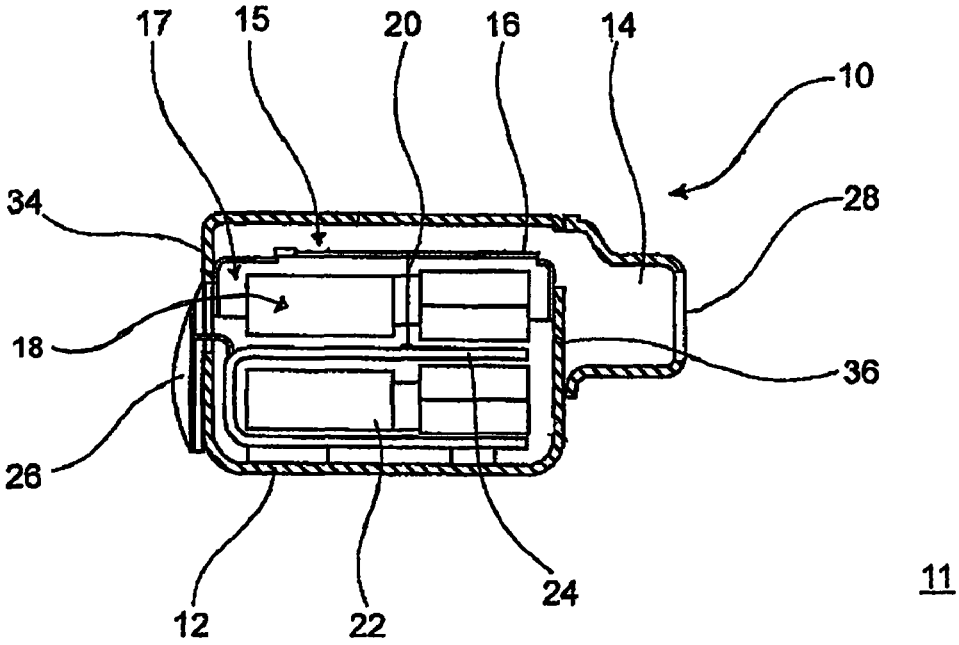
FIG. 1 illustrates a sound producing transducer according to one embodiment of the invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENTS

In general, in relation to the invention, a few comments are pertinent:

In general, the gas flow channels are provided for, for example, atmospheric pressure equalization of the chambers, which is desired when the transducer is subjected to changes in ambient pressure, such as from variations in its height over sea level (travelling in elevators, airplanes, or the like). However, it is generally undesirable that any sound is leaked from the inside out or from the outside to the diaphragm through the first and second gas flow channels. One reason for this is seen when the transducer is used in a communication device such as a hearing aid in which a leaking sound pressure from the internal of the transducer housing could cause a disturbing feed back signal to a microphone of the communication device. This type of gas flow channel or channels may, as will be illustrated further below, have any of a large number of shapes and dimensions.

In one embodiment of the first aspect, the first gas flow channel facilitates gas transport between the first chamber and the surroundings and the second gas flow channel facilitates gas transport between the second chamber and the surroundings.

In this situation, the gas flow into or out of each chamber may be controlled separately, by the dimensions of each channel. Also, the channels may be positioned independently of each other to allow separate control of acoustical properties of each channel. This positioning may be optimized in relation to, for example, a sound pressure in the pertaining chamber so that a position may be chosen where the sound pressure is the lowest (maybe also depending on a given frequency range).

In a preferred embodiment, however, the first gas flow channel facilitates gas transport between the first chamber and the surroundings and the second gas flow channel facilitates gas transport between the first chamber and the second chamber. One reason for this is that apertures having openings to the surroundings may be polluted or blocked by dust or debris. Even during manufacturing of the transducer, operations may be performed (e.g., polishing or working/cutting metal or plastics) that may generate dust which may cause problems even before the transducer leaves the production plant. Providing one of the channels inside the transducer housing reduces this problem.

In one situation, this second channel may be provided in any position in the housing, such as in the form of a small aperture in the diaphragm such as a circular vent with a diameter of between 3 and 100 μm such as between 3 and 30 μm or even more preferably between 3 and 20 μm.

When the first channel extends between a chamber and the surroundings, it may advantageously have dimensions providing a transfer function between a sound pressure within the first chamber and a sound pressure at an opening of the first channel toward the surroundings. The transfer function comprises a low pass filter having a cut-off frequency, measured under free field conditions, of less than 100 Hz, such as less than 50 Hz, or less than 20 Hz. Naturally, the other vent may also have this characteristic. In this manner, the desired atmospheric pressure equalization is provided while at the same time, leakage of sound to or from the outside through the channel is prevented or limited to a frequency range below the operational frequency range of the communication device which houses the electro-acoustical transducer.

In the present connection the sound pressure at the opening of the gas flow channel toward the surroundings is normally determined under controlled circumstances, such as at a predetermined distance from that opening. A test of this type may be performed on a receiver or loudspeaker according to the invention by positioning a miniature microphone at a distance of, for example, about 1-10 cm from the opening. The transducer and miniature microphone are located under simulated free field conditions such as in an anechoic test chamber or anechoic room. A predetermined sound pressure is generated inside the housing of the transducer by applying a predetermined electrical stimulus input signal to a motor means operatively connected to the diaphragm so as to excite the diaphragm.

In a receiver, the test may be made by blocking the sound port so as to make it sound impermeable. Then, a predetermined sound pressure is provided outside the receiver, and the sound pressure entering the receiver via the ports is determined using the receiver itself.

Just as well as it may be desirable to be able to select the positions inside the chamber(s) for the opening(s) of the vent(s), it may be desirable to determine where the opening(s) to the surroundings is/are positioned. Thus, the sound port may be provided at a first, predetermined position of the housing and one or both of the gas flow channels can facilitate gas flow between a chamber and the surroundings. The channel(s) may be provided at an opposite position of the housing. In this manner, any sound exiting or impinging on the sound port may have a less significant role at the positions of the channel(s). In this situation, the opposite position may be diametrically opposite to the sound port or the channel opening(s) may be provided in side parts opposite to a side part in which the sound port is provided.

In one embodiment, the transducer further comprises motor means for deflecting the diaphragm in response to an electrical signal and means for providing an electrical signal to the deflecting means. The motor means may be based on a moving coil operation or on moving armature operation to provide a loudspeaker or sound producing transducer. The means for providing the electrical signal may comprise a digital or analogue power amplifier or other signal generator.

In another embodiment, the transducer further comprises means for providing an electrical signal corresponding to a deflection of the diaphragm and means for receiving an electrical signal corresponding to a deflection of the diaphragm. In this manner, a microphone or a sound detecting transducer is provided. The means for receiving the electrical signal may then be an amplifier and/or a circuit for processing and outputting a signal correlated to the sound detected.

In a particularly preferred embodiment, the sound port is substantially impervious to gas. This may be obtained by covering the sound port with a sound transporting member, such as a thin compliant membrane, which is substantially impervious to the flow of gas. Sound may be transported through the member in a substantially transparent manner by choosing a suitable flexible or deflectable fabric for the thin compliant membrane.

This sound transporting member has the advantage that debris, dust, sweat, or other liquids are unable to block the sound port or actually enter into an interior of the transducer and damage the sensitive elements contained therein. A problem encountered with prior art electro-acoustical transducers when blocking the sound port with a sound transporting member that is impervious to gas flow, is the lack of pressure equalization in one of the chambers. Prior art transducers have traditionally used the sound port for static pressure compensation. However, due to the provision of gas flow channels for both chambers, this problem has been circumvented and solved in transducers according to the present invention.

It should be noted that the housing may comprise an extension, such as a pipe stub, for easy attachment and positioning of the transducer to other elements of a larger assembly, such as a portable communication device, comprising the transducer. The sound port may then be provided in the distal end of the stub and the blocking or sealing member at any position from the sound port at the distal end to the chambers in the housing. In fact, one of the channels may be provided from a chamber to the internal space of the pipe stub so as to interconnect the two chambers.

As to the second aspect, the sound transporting member may be provided for a number of reasons such as to transport sound to or from another part of the assembly to the sound port. The member may be detachably attached to the housing of the transducer and may be provided with the blocking member before or after this attachment. In addition, the member may comprise a thin compliant membrane or diaphragm in order to facilitate a more free positioning of the transducer in relation to the sound port. Preferably, the member is airtight between the blocking member and the transducer. The blocking member may be positioned at an end of the member opposite to an end connected to the transducer.

In one embodiment particularly suitable for hearing aid applications, the blocking member comprises a wax-barrier or wax-filter. In other embodiments, the blocking member is a membrane or a diaphragm. Alternative materials may be metals, plastics, polymers, silicone, or rubbers. Such membranes may be, for example, a 10-100 μm film or foils of Polyethylene or Teflon.

As to the third aspect, a plane of a side portion is a plane co-extending with that side portion. Naturally, this plane may be flat or bent in any direction or manner. In this connection, the channel extends along the plane when a general axis of the channel is in the plane. This is in order to facilitate a channel having a length longer than the thickness of the side portion. The part of the channel extends within the side portion and may be defined by part of the material defining the side portion. Then, the at least part of the channel may have a meandering shape in order to be able to increase a length of the channel without having to change overall dimensions of the transducer. The meandering shape may be a flat spring-shape or a serpent/sine-shape.

The length, cross section, and shape of the channel defines its acoustic properties. Another manner of controlling the acoustic properties of the channel is to provide one or more cavities therein along the length thereof. Such cavities also affect the acoustic properties and may be used for providing a more effective (higher order) low pass filtering of sound travelling in the channel. These cavities will normally have a larger cross section than neighbouring parts of the channel.

The cross section of the channel and/or cavities may be predetermined and may, for example, be semicircular or have any particular shape. The side portion may be defined by two elements coextending in the plane, the channel being defined between the two elements. In that manner, the provision of the channel and the cross section of the channel are made easy in that the channel may be provided simply by providing a groove in one of the elements. In fact, a corresponding (in shape and position) ridge may be provided in the other element so that these two elements (the ridge being positioned in the groove) will cooperate in defining the cross section of the channel.

Punching, embossing, or injection moulding processes may be made with an impressing precision, so that the above method may be used for actually providing very narrow channels with well-defined cross sections. Also, in order to prevent or make difficult the blocking of the opening of the channel toward the surroundings with, for example, dust or debris, it may be desired that the channel at the second opening widens toward the surroundings. Thus, a larger exit opening out of the transducer is provided.

As to the fourth aspect, normally, the term miniature transducer designates a small or sub-miniature transducer such as one having an extension, in the plane of the diaphragm, of less than 7.0×5.0 mm or less than 5.0 mm×4.0 mm, such as 3.5 mm×3.5 mm, or even more preferably less than 3.0 mm×3.0 mm. Alternatively or additionally, a miniature transducer may comprise a so-called MEMS based transducer element which is a transducer element wholly or at least partly fabricated by application of Micro Mechanical System Technology. The miniature transducer element may comprise a semiconductor material such as Silicon or Gallium Arsenide in combination with conductive and/or isolating materials such as silicon nitride, polycrystalline silicon, silicon oxide and glass. Alternatively the miniature transducer element may comprise solely conductive materials such as aluminium, copper, etc., optionally in combination with isolating materials like glass and/or silicon oxide.

Naturally, the transducer may be used in larger applications such as in mobile telephones or PDA's.

As to the fifth aspect, in this manner, the specific sound characteristics of the gas flow channel may be defined by the porous member and not the opening in the housing. Normally, very small and well-defined gas flow channels are desired that are difficult to provide in this type of housing.

As mentioned above, the gas flow channel may have any desired transfer function between a sound pressure within the housing and a sound pressure at an opening of the gas flow channel toward the surroundings. This transfer function may be that of a low pass filter having a cut-off frequency, measured under free field conditions, of less than 100 Hz, such as less than 50 Hz, or such as less than 20 Hz.

The porous member may be positioned inside the housing or on an outer surface thereof. Preferably, the porous member is attached to the housing, such as by gluing, welding, soldering or clamping. Normally, all of the opening in the housing is covered by the porous member in order to have the porous member define the sound characteristics of the gas flow channel.

Porous materials, in general, may have a plurality of holes or channels extending in parallel or more stochastically or uncontrolled. The holes or channels will facilitate gas transport from one surface of the member to the other. The holes or channels may have the same cross section along their lengths, or the cross section thereof may vary.

In one embodiment, the porous member comprises a foil comprising a plurality of through-going holes positioned in gas flow connection with the opening. The holes may be parallel and directed perpendicularly (or at least at an angle to) to a surface of the foil. Alternatively, the holes may be meandering and at least partly extend also in the plane of the foil. Any number of holes may be provided. The number of holes, the thickness of the foil (the length of the holes), as well as the size (normally diameter) of the holes will take part in the definition of the sound characteristics of the gas flow channel.

It may be desired that the foil has a porosity between 0.05% and 3% in a volume comprising the holes. This volume normally is defined as a volume delimited by a boundary rather closely encircling the holes.

In another embodiment, the porous member comprises a grid comprising a plurality of through-going holes positioned in gas flow connection with the opening. A grid normally is a pattern of holes or openings. These holes may, as in the first embodiment, be parallel and to an angle to a surface of the grid or may be meandering. Preferably, the grid has between 2 and 50 holes having a radius between 1.8 μm and 30 μm. One grid has 2 holes with a radius of 3.5-21 μm. Another grid has 4 holes with a radius of 2.9-17.7 μm. An alternative grid has 8 holes with a radius of 2.5-14.9 μm, and yet another grid has 25 holes with a radius of 1.8-11.2 μm.

A third embodiment is one wherein the porous member comprises a foam, a web, or a ceramic comprising a plurality of through going holes positioned in gas flow connection with the opening. Such types of materials define a plurality of meandering channels there through.

As is described above, both the sizes of the holes, the meandering shape, the porosity, as well as the thickness take part in the definition of the sound characteristics of the porous member. In one embodiment, the porous member has a porosity between 0.02% and 15% and a thickness, in a direction away from the opening, of between 10 μm and 300 μm.

Naturally, the fifth aspect may be combined with any of the other aspects in order to provide the particular venting using this porous member.

Returning now to the figures, in FIG. 1, a moving armature electro-acoustical transducer or receiver 10 is illustrated having a housing 12, a sound port 14, a diaphragm 16, and a driving mechanism or motor 18 for driving the diaphragm 16 via a drive rod 20. The drive mechanism comprises a drive coil 22 driving an armature 24 to which the drive rod 20 is connected. The diaphragm 16 divides an interior space into a first or front volume/chamber 15 directly connected to the sound port 14 and a second or back volume/chamber 17 that comprises the motor 18.

The drive coil 22 is electrically connected to externally accessible terminals 26 to which an electrical signal may be provided which is subsequently transformed to a corresponding sound pressure and emitted via the sound port 14. The sound port 14 is closed or blocked by a thin compliant membrane 28 which is sound transmissive but gas impermeable.

The front volume 15 and back volume 17 are pressure equalized to the surroundings by two vents, or gas flow channels, positioned at the positions identified by numbers 34 and 36. It is seen that the volume 17 is vented via the vent 36, the volume 15, and the vent 34. Alternatively, the vent 36 may be provided in the diaphragm 16 or directly between the volume 17 and the surroundings 11.

A sound recipient device or microphone in accordance with the present invention would also have a front and back volume divided by a deflectable diaphragm 16. However, the driving mechanism or motor 18 of the receiver 10 would then be replaced with means for sensing the movement of the diaphragm 16.

Figure 2:
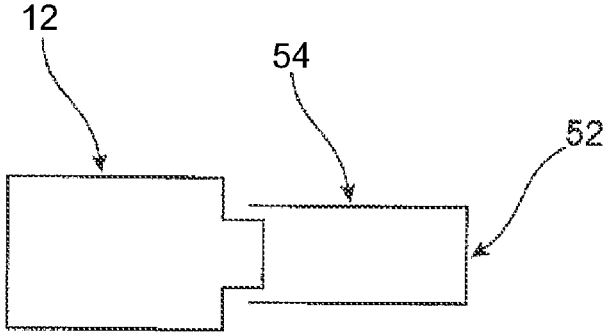
FIG. 2 illustrates a transducer and an extending member.

FIG. 2 illustrates another embodiment in which an extension member 54 is connected to the housing 12, and where the extension member 54 is closed by a membrane or closing member 52 adapted to transport sound but prevent gas transport.

In any case, the vent(s) preferably have their outlets toward the surroundings as far from the output of the sound port 14 as possible in order to minimize any sound leakage or cross talk of sound along that path. One position of the vent(s) is beneath an elastomeric rubber suspension or "boot" normally used in hearing aids for decoupling receiver vibrations from the shell of the hearing aid. An effective pipe diameter of less than 100 μm such as about 50 μm will be sufficient to compensate for normally encountered pressure variations.

In the following, a number of manners will be described for providing a vent or gas flow channel in transducer housings. Naturally, one or more such vents or different vents may be provided in a transducer, and a vent may still be provided interconnecting the front and back volumes so that both these volumes may be vented through a single vent to the outside of the transducer.

Figure 3:
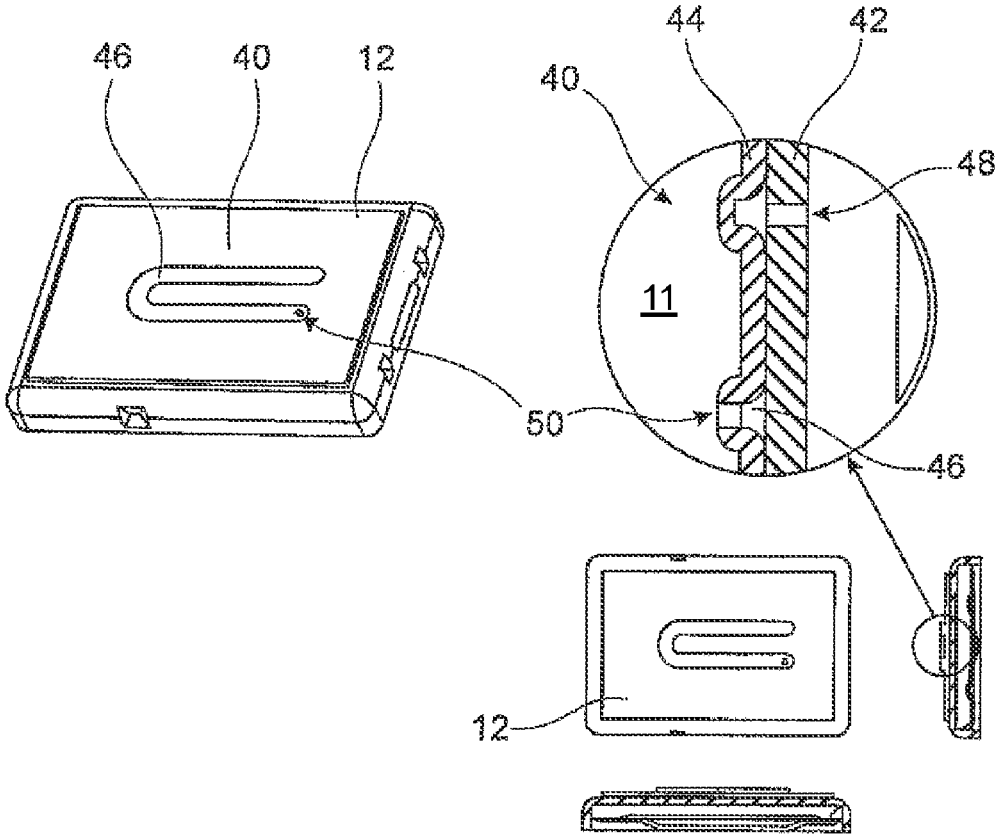
FIG. 3 illustrates a first manner of providing a vent.

FIG. 3 illustrates one manner of providing a gas flow channel in the transducer housing 12. The gas flow channel is to be provided in a side portion or side wall 40 of the housing 12. This side portion comprises two parallel elements 42 and 44 which abut each other and there between form a channel 46 that extends in a plane of the elements 42 and 44 and the side wall 40. At either end, the gas flow channel 46 is connected to either the inner chamber of the housing 12, at opening 48 toward the interior of the housing 12, or the surroundings 11, at opening 50. The opening 48 is a hole through the element 42, and the opening 50 is a hole through element 44.

It is seen that the channel 46 has a cross section and a shape defined by a groove formed in the element 44, such as by punching or embossing. It is also seen that any shape of the groove and channel may be obtained, such as a U-shaped, a spiral shaped, a sine-shaped channel, or the like.

Figure 4:
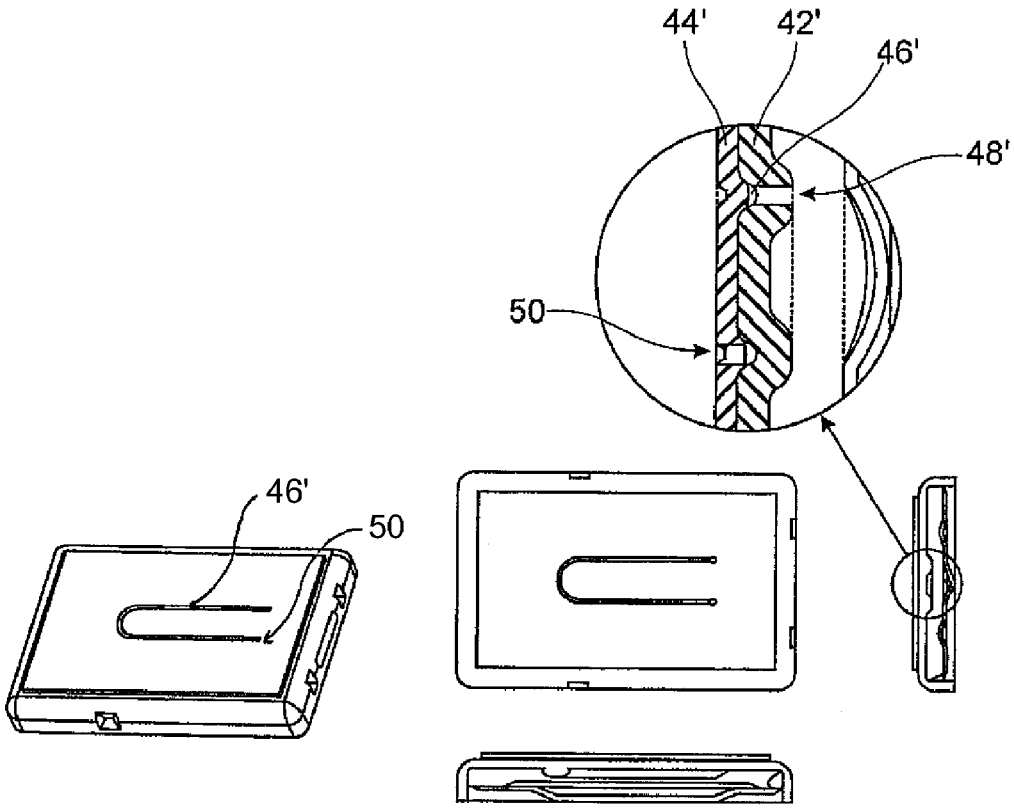
FIG. 4 illustrates a second manner of providing a vent.

FIG. 4 illustrates another manner of providing a gas flow channel or vent where also the element 42, now denoted 42', deviates from a flat shape. In this embodiment, the element 42' forms a groove into which a ridge of the element 44' extends, whereby a channel 46' is formed with a different cross section.

In these embodiments, the channel 46/46' preferably has a 0.1 mm diameter and a length of 6 mm. Since the acoustical resistance is proportional to the pipe length and inversely proportional to the 4th power of the pipe diameter, increasing the diameter rapidly leads to a very long pipe for a given acoustical resistance.

As to the cross section of the channel, a semicircular shape is desirable in that it provides a lowest possible cut-off frequency for a maximum given dimension.

The channel 46 may alternatively be provided by providing a flat member, such as a flat plate, a film, or the like, having the channel cut out therein. This flat member is provided between the first and second elements in which the holes are provided at the inlet and outlet of the channel, whereby the channel is formed.

In order to avoid glue entering into the channel, a Teflon spray may be sprayed through a shadow mask to an area corresponding to that of the channel 46 so that, when the flat member and the first/second element are glued together, the glue will not stick in the channel 46. Either the glue will not travel into the channel, or it may be removed from the channel such as by pressurized air. Alternatively, the glue may be prevented from entering the channel by a film line of polyether-urethane in much the same manner as the above Teflon spray.

In one embodiment, a substantially plane plate is used on the inside of the receiver top cover, so that the pipe is created by the concave shape of the cover towards the outside of the receiver due to the metal drawing process applied during manufacturing. Thus, by simply providing this plate inside the cover a thin channel is provided. More such channels may be provided by providing plates at multiple surfaces of the cover. A plurality of channels in parallel has more resistance against clogging of one or more individual channels.

Figure 5:
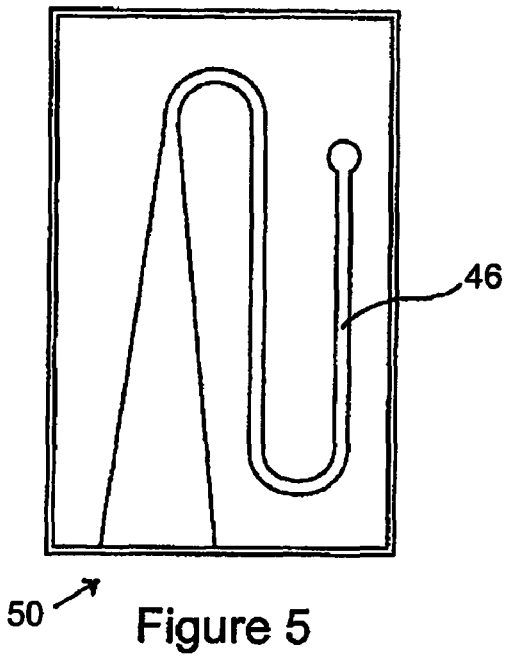
FIG. 5 illustrates a vent with a tapering opening.

In FIG. 5, a widening shape is illustrated which may be desired in the channel 46 at the opening 50 toward the surroundings. In this manner, the opening will be harder to block by dust or debris. This shape is easily provided in the channel by the above production methods. In addition, it may be desired to provide this enlarged opening at a corner of the side part.

Figure 6:
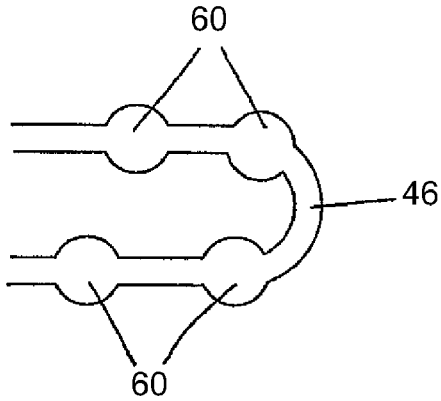
FIG. 6 illustrates a channel with enlarged chambers.

In FIG. 6 a lateral cross-sectional view of a gas flow channel 46 is illustrated comprising a number of chambers 60 along the lateral extension of the gas flow channel 46 or channels. These chambers 60 take part in the definition of the acoustical properties of the channel 46 by operating as acoustical capacitances. The inclusion of the chambers 60 will provide the channel 46 with a more effective (higher order) low pass filtering of sound traveling in the channel.

Figure 7:
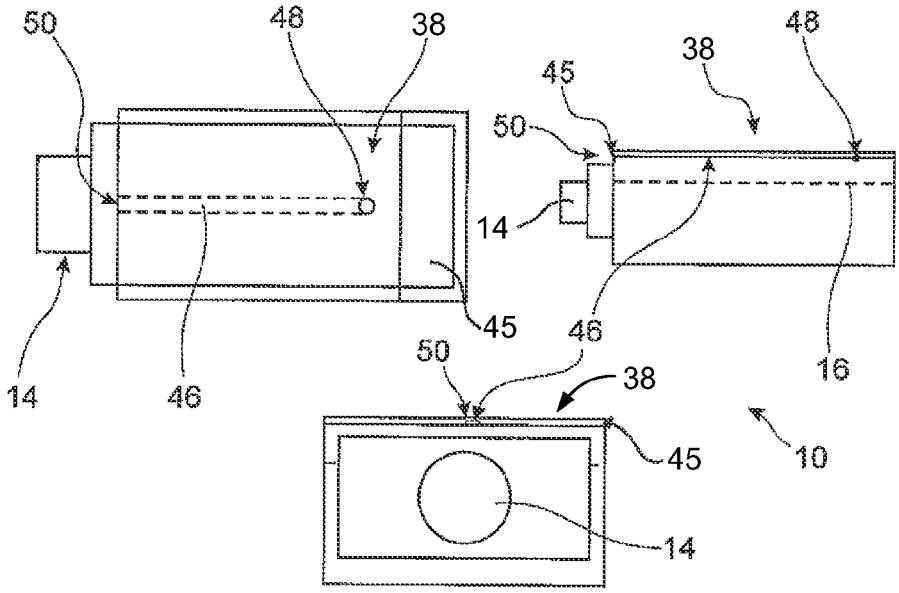
FIG. 7 illustrates a third embodiment according to the invention.

FIG. 7 illustrates an embodiment, seen from above, the side, and from the front. In this figure, the transducer 10 comprises a normal spout 14 and a membrane 16. A hole 48 is made in the top cover 38 of the transducer 10 and a foil 45 is provided at the hole 48 and having a laser cut or edged channel 46 therein. This channel leads from the hole 48 in the cover to an opening 50 at the spout end. The channel 46 is closed along its length by a top cover 38. The dimensions of the hole 48 and the channel 46 define the acoustical properties of the gas flow channel responsible for venting the interior of the transducer 10. The advantage of this channel construction is that it is not clogged when soldering the external terminals to the leads providing the transducer with power and/or from which electrical signals are provided or received.

Figure 8:
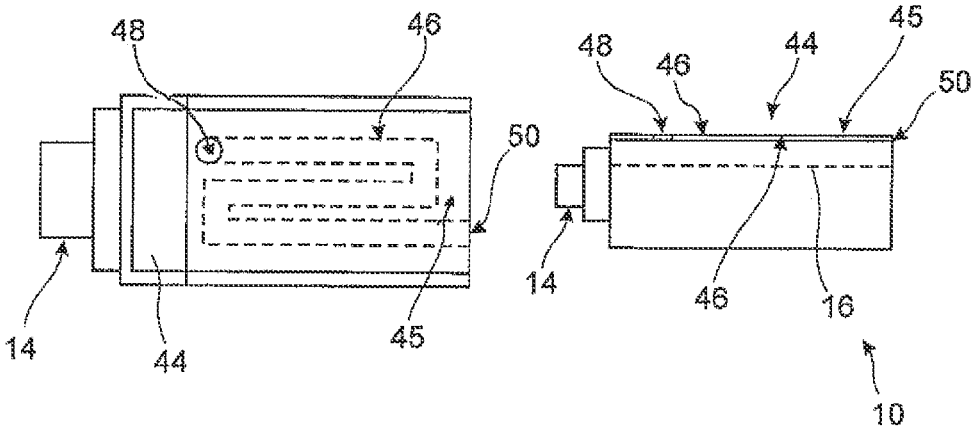
FIG. 8 illustrates a fourth embodiment according to the invention.

FIG. 8 illustrates another embodiment in which the gas flow channel 46, which may be provided in the same manner as in FIG. 7, is meandering and thereby longer. It now opens 50 toward the other end of the transducer 10. The advantage of this meandering channel 46 is that the opening 48 may be made larger without adversely affecting the properties of the venting. In addition, larger or wider channels 46 or openings 50 are less easily clogged and polluted.

Figure 9:
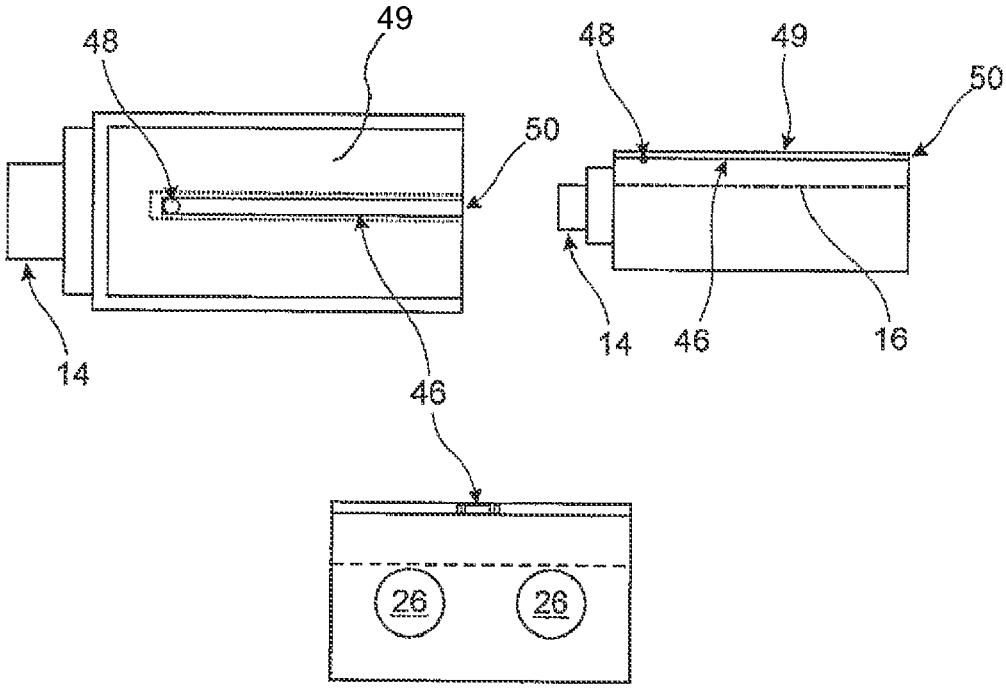
FIG. 9 illustrates a fifth embodiment according to the invention.

FIG. 9 relates to an embodiment in which a plastic cover 49 is provided on the cover of the transducer 10 and covering the hole 48 in the cover of the transducer. In the cover 49 three parallel channels are provided. The outer channels are filled with glue in order to fasten the cover 49 to the transducer 10 and in order to prevent gas and sound from entering or exiting the channel 46 at other positions than the hole 48 and the opening 50.

Figure 10:
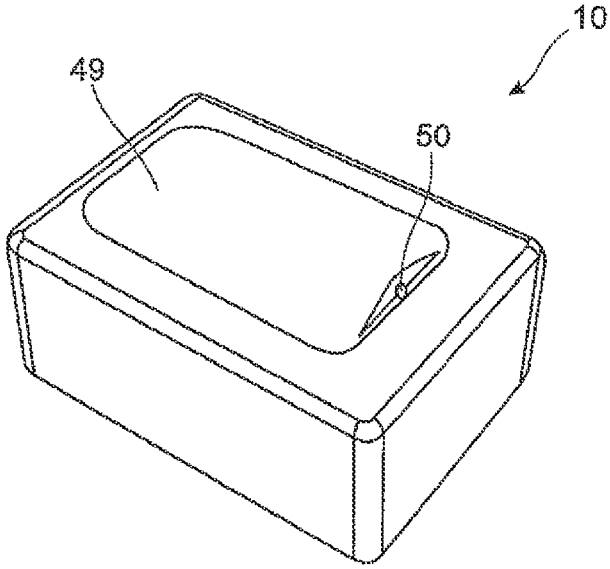
FIG. 10 illustrates the fifth embodiment of FIG. 9 as seen from above.

FIG. 10 illustrates a 3D model of the embodiment of FIG. 9, wherein the transducer 10 is seen with the cover 49 attached thereto. The opening 50 is also seen. The advantages of this embodiment are that it is easily adaptable to existing transducers and that different covers 49 with different channels 46 and different positions of the opening 50 are easily constructed to allow a wide range of acoustical properties of the gas flow channels. One such type of cover, 49', is illustrated in FIG. 11 which illustrates an embodiment with a vent of sophisticated design and may be tailored to fit or fulfill complex acoustical filtering requirements.

Figure 11:
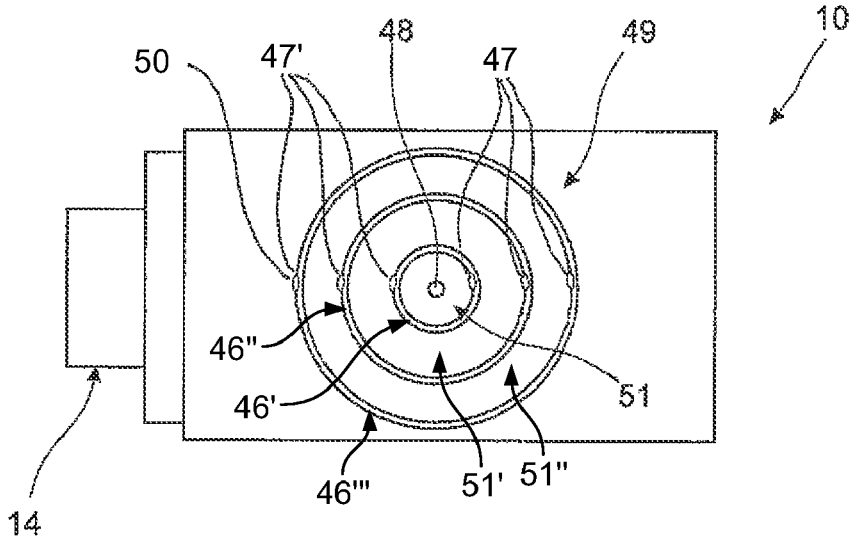
FIG. 11 illustrates a sixth embodiment according to the invention.

The cover 49' of FIG. 11 has therein a number of concentric cavities 51, 51', 51", namely an inner cavity 51, a middle cavity 51', and an outer cavity 51", and having there between round channels, namely an inner channel 46', a middle channel 46", and an outer channel 46'". Each of the inner, middle, and outer channels 46', 46", 46'" has a corresponding opening 47' toward the outer periphery thereof to the left in the figure and a corresponding opening 47 to the inner periphery at the right thereof. The opening 48 through the cover of the transducer 10 is positioned in the inner cavity 51.

Gas venting from the hole 48 or aperture now firstly enters the inner cavity 51, and travels through the inner channel 46' by entering the opening 47 at the right side of the inner channel 46'. The gas then travels around in the inner channel 46' to the left side thereof and enters the next cavity (the middle cavity 51') through the corresponding opening 47'. The gas then travels around in the middle cavity 51' to enter the next channel (the middle channel 46") at the corresponding opening 47. This is repeated until the gas exits the outer channel 46'" and is vented to the outside.

In this manner, the gas is exposed to a number of narrower channels (e.g., the inner channel 46') and a number of wider cavities (e.g., the inner cavity 51, the middle cavity 51', and the outer cavity 51") which all provide this venting with acoustical properties closely linked with the dimensions thereof. Thus, in this manner, a wide range of desired acoustical properties may be obtained by a suitable interconnection of narrower and wider elements in the gas flow path from the (inner) hole 48 to the opening 50. The illustrated embodiment provides a fourth order low-pass filter by virtue of the cascade of acoustical inductances, capacitances, and resistances, but clearly higher or lower order low-pass filters may be constructed in suitable modification of the disclosed embodiment.

Figure 12:
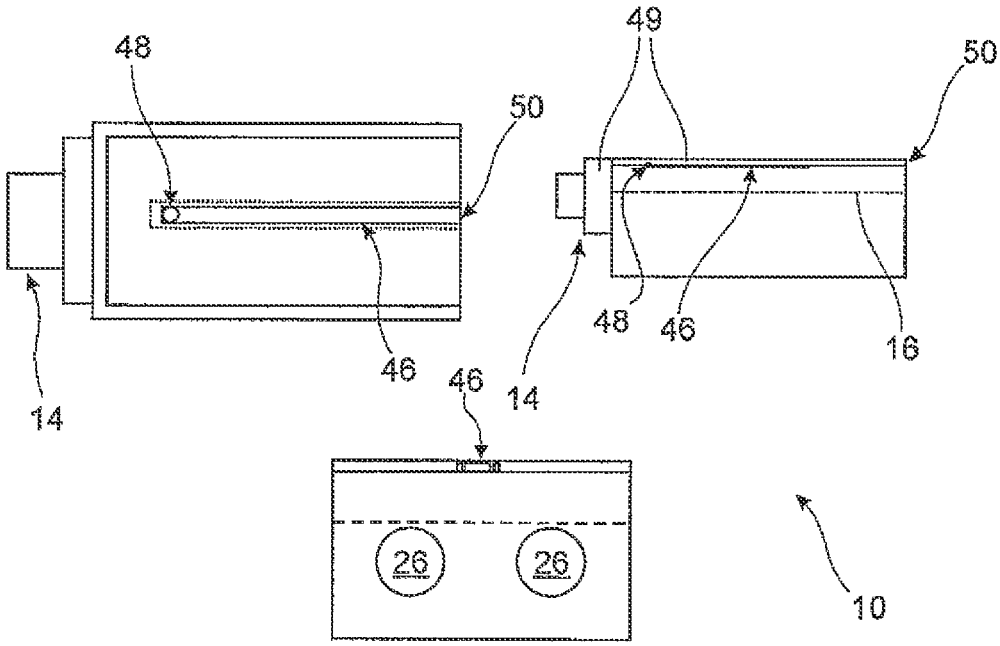
FIG. 12 illustrates a seventh embodiment according to the invention.

In FIG. 12, an embodiment closely resembling that of FIG. 9 is seen. In FIG. 12, however, the cover 49 and the spout part 14 are provided as a monolithic piece which may be glued on to (or fastened in any other suitable manner) to the transducer 10, which is now of a spout-less type.

FIG. 13 illustrates another manner of positioning the hole 48 in the cover of the transducer 10. In this embodiment, the hole 48 is provided in the spout 14 of the receiver 10. In this manner, a standard receiver may be used, and the hole 48 will not be clogged when soldering the transducer.

FIG. 14 illustrates yet another position of providing the venting of the transducer 10. In this embodiment, the venting is provided through the rear surface of the transducer, typically through a miniature substrate or PCB 25 which is provided for holding externally accessible solder pads or terminals 26.

In the upper illustration of FIG. 14, the hole 48 through the transducer wall and PCB 25 is covered by a protective grid 29, which both reduces the overall diameter of the hole 48 and which also prevents pollution and clogging of the hole 48 by ear wax, sweat, etc.

In the lower illustration of FIG. 14, the hole 48 in the transducer wall is provided under the PCB 25 that has a channel or slit 27 inside itself or at its backside (where it is then closed between the PCB 25 and the transducer wall), which channel or slit 27 vents from the hole 48 to an opening 50 at a side of the PCB 25.

Figure 15:
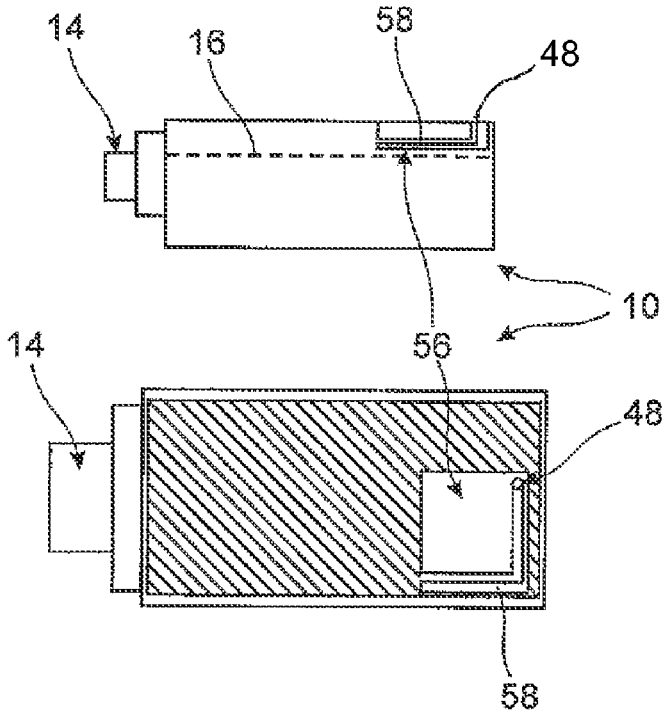
FIG. 15 illustrates a tenth embodiment according to the invention.

FIG. 15 illustrates yet another manner of providing venting in a receiver 10 wherein an element 56 is positioned inside the cover of the transducer 10 and which has a gas flow channel 58 opening into the opening 48 of the cover of the transducer at one end and opening toward the interior of the transducer 10 at the other end. Naturally, this gas flow channel 58 may have any shape within the element 56. The use of the illustrated element 56 has the advantage that it does not change the outer dimensions of the transducer 10 and that it is not easily clogged. Also, the same element 56 may be used in many different transducers 10.

Figure 16:
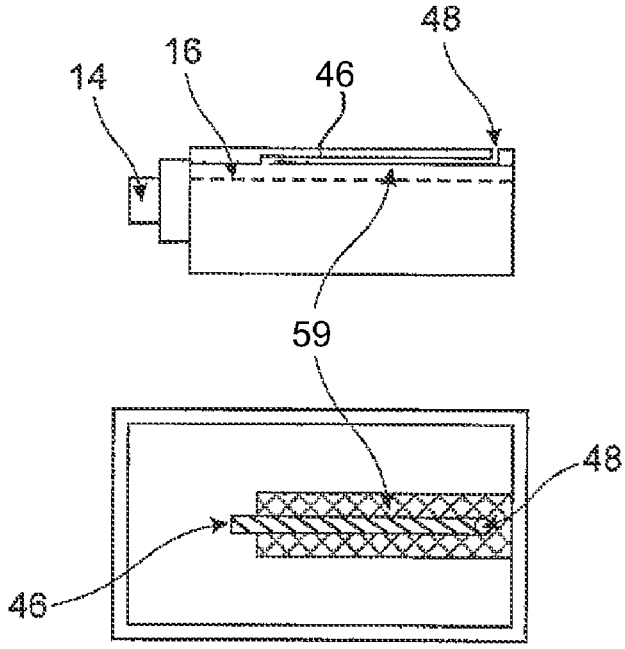
FIG. 16 illustrates a eleventh embodiment according to the invention.

Another embodiment is seen in FIG. 16, wherein the gas flow channel 46 is provided inside the cover of the transducer 10. This gas flow channel 46 is provided by providing a channel 46 in the inner surface of the cover and covering part of this channel with a foil/plate 59 in order to close the channel 46 at a part of its length. Again, this channel 46 opens at one end into the inner volume of the transducer 10 and at the other end to the hole 48 to the surroundings. An advantage of this embodiment is the fact that it does not alter the outer dimensions of the transducer. It may, however, be desired to control the vibrating properties of the foil/plate 59 in order for this element to not interfere with the sound in the transducer 10.

Figure 17:
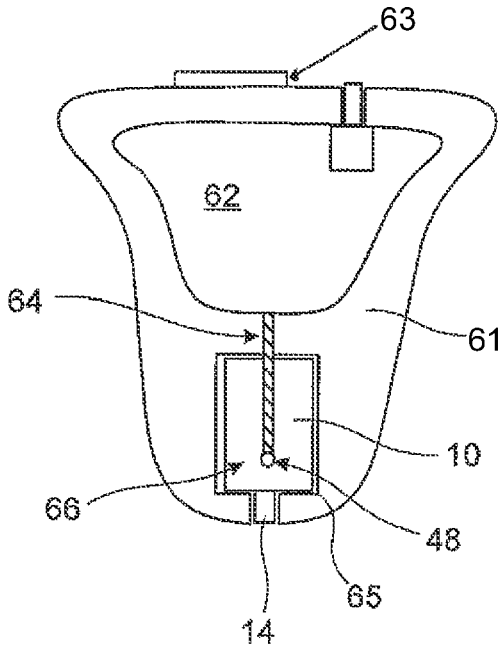
FIG. 17 illustrates a twelfth embodiment according to the invention.

FIG. 17 illustrates an embodiment of a transducer positioned in a hearing aid, such as in an SLA shell in an ITC or CIC hearing aid 61. This hearing aid 61 comprises a cavity 65 for holding a transducer 10 having a spout 14 and an opening 48 from the inner space thereof to the surroundings. In this cavity 65, the shell 61 has a slit 64 which is covered by the transducer 10 to form a channel 66 in gas flow connection with the opening 48. This slit 64 further opens from the cavity 65 into an inner compartment 62 of the hearing aid 61 that may hold a battery and/or amplifier. The transducer 10 will have a gas flow channel through the inner compartment 62, which in turn is connected to the external environment through slits and opening 63 around the movable battery compartment.

Figure 18:
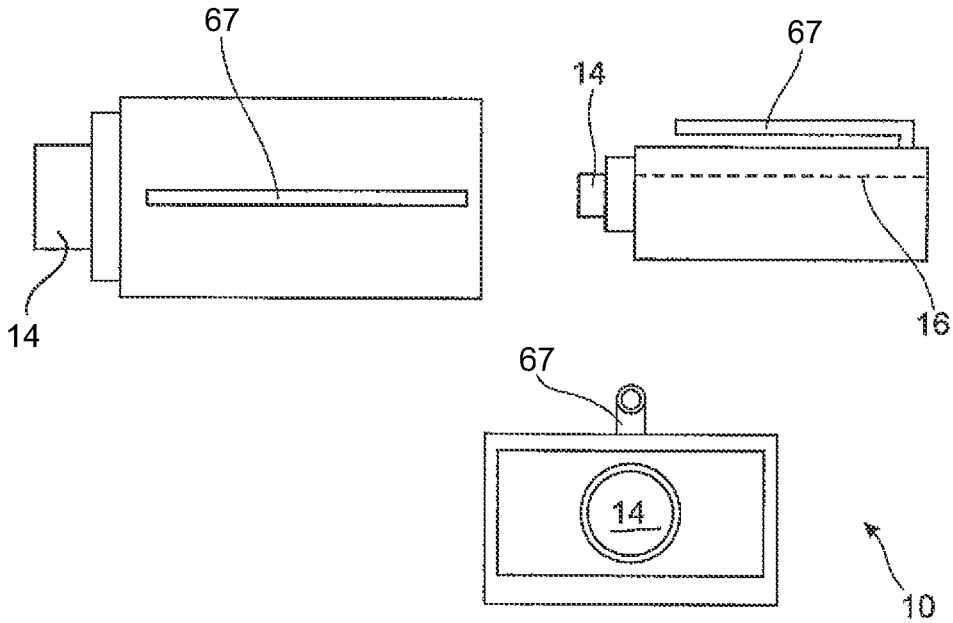
FIG. 18 illustrates a thirteenth embodiment according to the invention.

FIG. 18 illustrates an embodiment in which the venting is provided via an external element 67 having a tube providing the required characteristics of the venting. This tube may be, for example, a hollow needle, such as with a length of 6 mm and a diameter of 0.1 mm. This tube 67 may be attached to or combined with any opening in the transducer 10, such as in the cover as seen in, for example, FIG. 12, provided in the PCB as seen in FIG. 14 or an opening provided in the spout.

Figure 19:
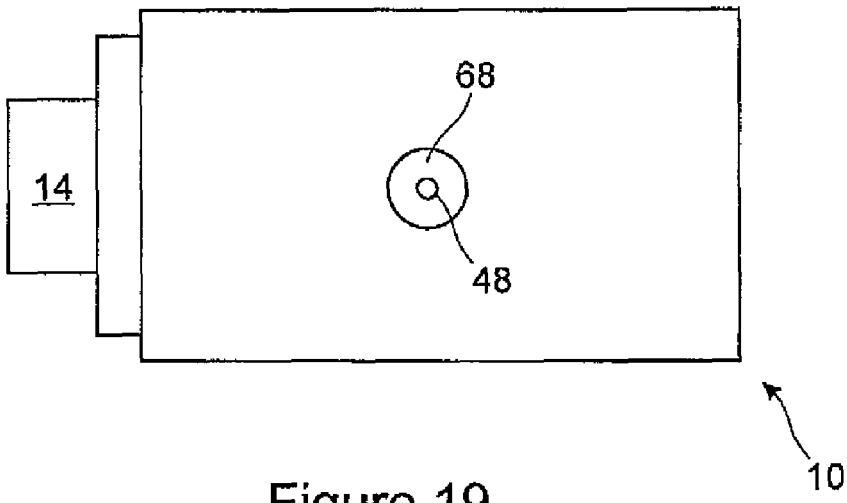
FIG. 19 illustrates a fourteenth embodiment according to the invention.

FIG. 19 illustrates a quite different type of embodiment in which the opening 48 in the cover is covered by a foil 68 in which a hole much smaller than the hole 48 is provided. It is much easier to provide very small holes (see further below) in foils compared to thicker walls as those of the transducer 10. This drilling of very small holes in a foil may be made, for example, using a laser. Naturally, the foil 68 may vibrate due to the sound pressure over it, but as the hole 48 itself may be made relatively small, this vibration may be kept at an acceptable level.

Figure 20:
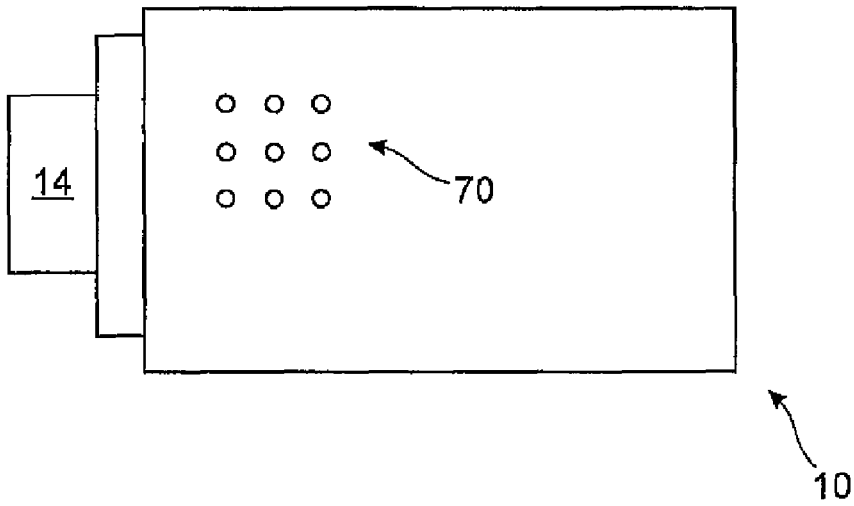
FIG. 20 illustrates a fifteenth embodiment according to the invention.

FIG. 20 illustrates a transducer 10 having in its cover a plurality of smaller holes provided in a grid or suitable pattern 70. The number of holes defines the amount of air or gas which may flow there through and the dimensions of the holes define the acoustical characteristics of the vents.

Figure 21:
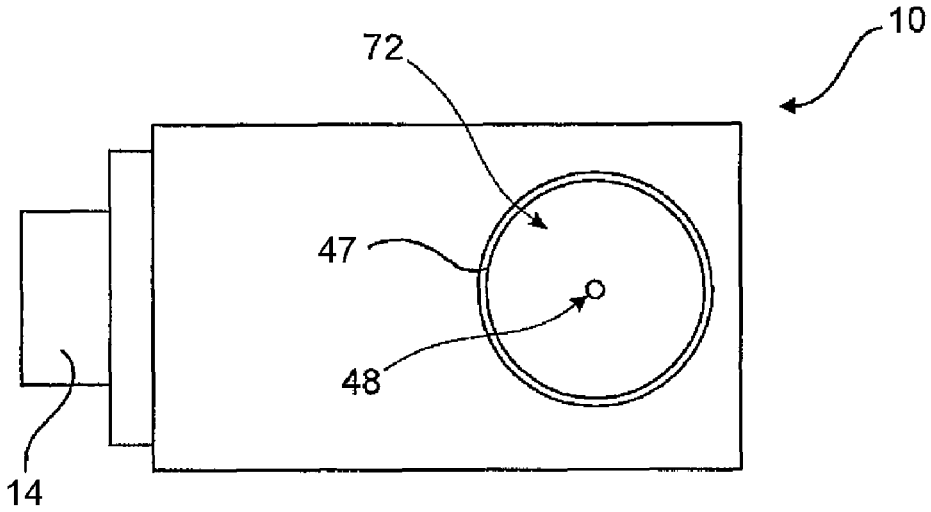
FIG. 21 illustrates a sixteenth embodiment according to the invention.

FIG. 21 illustrates an embodiment in which the hole 48 in the cover of the transducer 10 is covered by a foil or porous layer 72 glued to the cover of the transducer in order to make air venting through the hole 48 vent through the layer 72. In this manner, the porosity of the layer 72 will determine the characteristics of the venting, independent of the diameter or size of the hole 8. This will be described further below.

Figure 22:
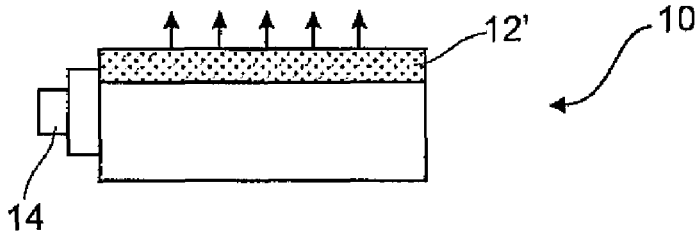
FIG. 22 illustrates a seventeenth embodiment according to the invention.

FIG. 22 illustrates an even more extreme embodiment in which a whole part 12' of the cover of the transducer 10 is prepared from a porous material which, by itself and with no requirement for an actual hole therein, will facilitate the flow of gas. Again, the porosity of this material (and the thickness, volume, area, etc.) will determine the venting and acoustical characteristics. The porous material may comprise ceramics or an air permeable micro-porous aluminium such as METAPOR.

Annex 1

In this annex, formulas are given for determining the acoustic impedance for a pipe with very small diameter:

$$R_a = \frac{8\eta \cdot l}{\pi \cdot a^4} \qquad [\Omega a]$$

$$M_a = \frac{4}{3} \cdot \frac{\rho \cdot l}{\pi \cdot a^2} \qquad [\mathrm{kg/m4}]$$

Note: the factor 4/3 is caused by the parabolic flow profile in a long thin pipe.

The acoustic impedance of the pipe is:

$$Z_a = R_a + j\omega \cdot M_a$$

For low frequencies the resistive term is dominant. The corner frequency is:

$$f_0 = \frac{1}{2\pi} \cdot \frac{R_a}{M_a} = \frac{1}{2\pi} \cdot \frac{8\eta \cdot l}{\pi \cdot a^4} \cdot \frac{3\pi \cdot a^2}{4\rho \cdot l} = \frac{3\eta}{\pi \cdot \rho \cdot a^2}$$

where $\eta = 18.6 \cdot 10^{-6}$ Pa-s (air viscosity coefficient @ 293 K, $10^5$ Pa)

$\rho = 1.29$ kg/m$^3$ (mass density of air @ 293K)

Annex 2

In this annex, it is described how to determine the venting properties of porous materials, such as grids, foams or the like. The present annex describes the calculations for a representative product. Other products having other pore sizes, wall thicknesses, or the like or with different requirements as to high frequency cut-off, naturally, should be calculated using other parameters.

Needed Pressure Compensation

External influences like, for example, temperature changes can cause an over- or under pressure in the receiver. This pressure difference between internal chambers of the receiver and outside world causes increases in distortion and needs to be compensated for through a gas flow channel or vent.

In some cases there can be quite rapid increase or decrease of environmental pressure. This could for example happen when a person is in an elevator in a very high building and travels from the ground level to the top level. The same holds when traveling by plane during take off and landing. Other situations can be getting in and out of an air conditioned car during a hot day. In all these cases, it is desirable to compensate for this change of environmental pressure within a certain time.

Say, 10% pressure increase max, dissipates to 10% in 10 seconds.

Minimum Dimensions of Holes

Say, 10% pressure increase max, dissipates to 10% in 10 seconds.

Simply like a RC network discharging:

$$Pc(t)=(\text{Pressure_difference})*e^{-t/RC}$$

where

V=pressure difference

R=acoustic resistance

C=acoustic compliance

After 10 seconds to 10%:

$$Pc(10) \leq 0.1 * Pc(0)$$

$$\downarrow$$

$$(\text{Pressure_difference}) * e^{-10/RC} \leq 0.1 * (\text{Pressure_difference})$$

$$\downarrow$$

$$e^{-10/RC} \leq 0.1 = e^{-2.30}$$

$$\downarrow$$

$$-10/RC \leq -2.30$$

$$\downarrow$$

$$RC \leq 10/2.30$$

C is given: acoustical compliance of the combined volume of front volume and tubing up to a sound penetratable, air impervious barrier.

Front volume: about $7.82e^{-9}$ $m^3$ (as in the Sonion 2300 series receiver manufactured by Sonion Netherlands BV)

Tubing: 10 mm (length)×1.4 mm (inner diameter)= $10e^{-3}*3.14*(1.4e^{-3/2})^2=15.4e^{-9}$ $m^3$ Acoustical compliance:

$$C=V/(\rho_air*c_air^2),\ \rho_air=1.2\ kg/m^3 \text{ (density of air)},\ c_air=344\ m/s \text{ (speed of sound in air)} \rightarrow C=(7.82e^{-9}+15.4e^{-9})/(1.2*344^2)=1.64e^{-13}\ m^5/N$$

So the resistance has to be less than:

$$R<(10/2.30)/C=4.35/1.64e^{-13}=2.66e^{13}\ Ns/m^5$$

Thus, the dimensions of the hole (assuming that a channel has a length equal to the receiver cover thickness and a width equal to the whole diameter) may be calculated.

$$r_a=(8*\mu_air*L)/(\pi*R\hat{}4),$$

where r_a=acoustic resistance

R=radius of channel

L=length of channel $\mu_air=1.81e^{-5}$ (viscosity of air)

So, $R=[(8*1.81e^{-5}*0.18e^{-3})/(3.14*r_a)]^{1/4}=[(8*1.81e^{-5}*0.18e^{-3})/(3.14*2.66e^{13})]^{1/4}=4.2\ \mu m$.

The diameter of the hole therefore should be at least 8.4 μm to dissipate a 10% change in pressure within 10 s to 10%.

Low Acoustical Influence: Maximum Dimension of Holes

We want the influence of the vent on the higher frequencies in which the receiver normally operates to be as small as possible. From simulation it appears that a hole in the cover of 50 μm already has a noticeably influence on higher frequencies. This is an acoustic resistance of:

$$r_a=(8*\mu_air*L)/(\pi*R^4)=(8*1.81e^{-5}*0.18e^{-3})/(3.14*(50e^{-6}/2)^4)=21.24e^9\ Ns/m^5$$

The hole in the receiver is about 0.3 mm diameter and will be covered with porous material. Since we want that the effective hole is no bigger than 50 μm diameter this will require a porosity of:

$$A\text{hole}=\pi R^2=3.14*(0.3e^{-3}/2)^2=70.6e^{-9}\ m^2$$

$$A\text{effective,desired}=\pi R^2=3.14*(50e^{-6}/2)^2=1.96e^{-9}\ m^2$$

$$\text{Porosity}<1.96e^{-9}/70.6e^{-9}=2.77\%$$

since porosity is defined as the surface of free flowing air/total surface.

This is of course also depending upon the size of the hole in the cover. For a 0.2 mm hole this will be:

$$\text{Porosity}<1.96e^{-9}/3.14*(0.2e^{-312})^2=6.25\%$$

A general formula is:

$$\text{Porosity}=1.96e^{-9}/(3.14*R\text{hole}^2)$$

This comes down to a porosity of less than 25% for holes bigger than 0.1 mm diameter.

Smaller holes in the cover will require higher porosity but are difficult to make.

Since the effective hole diameter is less than 50 μm in diameter, the pore size of the porous material should be considerably less than that, generally <5 μm.

Thickness of the porous material will be less than 2 mm to keep dimensions of the receiver small. Note that the thickness of the porous material together with the pore size defines the porosity.

Requirements for Different Manners of Providing Porosity or Small Holes

Only a Hole in the Cover

To obtain a vent with the desired specifications (pressure compensation within a certain time, and no acoustical influence on the normal operation of the receiver), there preferably is a hole in the cover of more than 8 Ξm and less than 50 μm. Hereby it is assumed that the cover has a thickness of 180 μm.

Porous Foil

With porous material this means (for a 0.3 mm hole in the receiver cover):

$$A\text{eff,min}=3.14*(8e^{-6/2})^2=5.03e^{-11}\ m^2$$

$$A\text{eff,max}=3.14*(50e^{-6/2})^2=1.96e^{-9}\ m^2$$

$$A\text{eff,holeincover}=3.14*(0.3e^{-3/2})^2=70.6e^{-9}\ m^2$$

So for porosity:

$$\text{Porous min}=5.03e^{-11}/70.6e^{-9}=0.07\%$$

$$\text{Porous max}=1.96e^{-9}/70.6e^{-9}=2.77\%$$

These values are very dependant on the diameter of the hole in the cover. Maximum pore size was already given, it should be less than 50 μm. Minimum pore size is difficult to give, the porosity lower limit should at least be realized for that given pore size. Thus, a large hole may be provided in the actual transducer cover, when this is further limited (as in FIG. 21, for example) by a foil with the above porosity.

Grid

If a grid is created in the cover with multiple holes (e.g., n holes):

$$r_a=r_a_\text{single}/n$$

where r_a_single=acoustic resistance of a single hole
r_a=acoustic resistance of multiple holes combined $$r_a=(8*\mu_air*L)/(n*\pi*R^4)$$

where n=number of holes $$r_a<2.66e13 \text{ (from 3)}$$

$$r_a>21.24e9 \text{ (from 4)}$$

Then, radius of the hole should be minimal:

$$R=[(8*1.81e^{-5}*0.18e^{-3})/(3.14*r_a*n)]^{(1/4)}=[(8*1.81e^{-5}*0.18e^{-3})/(3.14*2.66e^{13}*n)]^{(1/4)}$$

And maximal:

$$R=[(8*1.81e^{-5}*0.18e^{-3})/(3.14*21.24e^{9}*n)]^{1/4}$$

Thus, R for 2 holes: minimal 3.5 μm, maximal 21.0 μm
R for 4 holes: minimal 2.97 μm, maximal 17.7 μm
R for 8 holes: minimal 2.5 μm, maximal 14.9 μm
R for 25 holes: minimal 1.8 μm, maximal 11.2 μm
R defines the radius of each of the holes, not a diameter.

Foam

The calculation relating to the grid is also valid for foams in that the overall porosity of a foam also corresponds to a number of channels with determined pore sizes. That these channels in the foam will be meandering and interacting does not affect the throughput of air to any significant degree and does also not affect the acoustic properties of the venting.

While the present invention has been described with reference to one or more particular embodiments, those skilled in the art will recognize that many changes may be made thereto without departing from the spirit and scope of the present invention. Each of these embodiments and obvious variations thereof is contemplated as falling within the scope of the claimed invention, which is set forth in the following claims.

The invention claimed is:

1. An electro-acoustical transducer comprising a transducer housing, having one or more side walls and an inner space, the transducer comprising:

a deflectable diaphragm responsive to received sound or adapted to generate sound, the diaphragm dividing the inner space of the housing into a first and a second, separate chambers;

a sound port adapted to convey sound between the first chamber and the surroundings; and a channel extending between a first opening toward one of the first and second chambers and a second opening to the surroundings, the channel being adapted to facilitate gas flow there through between the first or second chamber and the surroundings, the channel having dimensions providing a transfer function between a sound pressure in the first or second chamber and a sound pressure at the second opening of the channel, the transfer function comprising a low pass filter having a cut-off frequency, measured under free field conditions, of less than 100 Hz, wherein at least a first part of the channel extends within one of the one or more side walls of the housing and along a plane of the one of the one or more side walls.

2. The transducer according to claim 1, wherein the at least part of the channel has a meandering shape.

3. The transducer according to claim 1, wherein the channel at the second opening widens toward the surroundings.

4. The transducer according to claim 1, wherein the at least a second part of the channel comprises one or more cavities.

5. The transducer according to claim 1, wherein at least a third part of the channel has a predetermined cross section.

6. The transducer according to claim 1, wherein the one of the one or more side walls is defined by two elements coextending in the plane, the channel being defined between the two elements.

7. The miniature hearing aid receiver, microphone, or loudspeaker comprising an electro-acoustical transducer according to claim 1.

8. The transducer according to claim 1, wherein the cut-off frequency is less than 50 Hz.

9. The transducer according to claim 1, wherein the one of the one or more side walls is defined by two co-parallel elements coextending in the plane, the channel being defined between the two elements and having a length that is longer than a thickness of the one of the one or more side walls.

10. The transducer according to claim 1, wherein a length of the channel is longer than a length of the housing.

* * * * *